US008720679B2

(12) United States Patent
Morimoto et al.

(10) Patent No.: US 8,720,679 B2
(45) Date of Patent: May 13, 2014

(54) CONTAINER FOR ORALLY INGESTED PHARMACEUTICAL COMPOSITION

(75) Inventors: Shuji Morimoto, Suita (JP); Yutaka Sakuma, Suita (JP)

(73) Assignee: Morimoto-Pharma Co., Ltd., Osaka (JP)

( * ) Notice: Subject to any disclaimer, the term of this patent is extended or adjusted under 35 U.S.C. 154(b) by 0 days.

(21) Appl. No.: 13/637,546

(22) PCT Filed: Mar. 29, 2011

(86) PCT No.: PCT/JP2011/057881

§ 371 (c)(1),
(2), (4) Date: Sep. 26, 2012

(87) PCT Pub. No.: WO2011/122640

PCT Pub. Date: Oct. 6, 2011

(65) Prior Publication Data

US 2013/0015085 A1 Jan. 17, 2013

(30) Foreign Application Priority Data

Mar. 29, 2010 (JP) ..... 2010-074941

(51) Int. Cl.
*B65D 69/00* (2006.01)
*B65D 30/22* (2006.01)

(52) U.S. Cl.
USPC ..... 206/219; 206/223; 206/277; 206/484; 206/828; 383/38

(58) Field of Classification Search
USPC ..... 206/219, 221, 222, 223, 277, 438, 484, 206/828; 604/410, 416; 383/38
See application file for complete search history.

(56) References Cited

U.S. PATENT DOCUMENTS

| | | | | | |
|---|---|---|---|---|---|
| 1,611,119 | A | * | 12/1926 | Lipper | 87/6 |
| 3,070,094 | A | * | 12/1962 | Sarnoff et al. | 604/89 |
| 3,478,871 | A | * | 11/1969 | Sager | 206/221 |
| 3,749,620 | A | * | 7/1973 | Montgomery | 206/219 |
| 3,847,279 | A | * | 11/1974 | Montgomery | 206/219 |
| 4,298,119 | A | * | 11/1981 | Murray | 206/219 |
| 4,402,402 | A | * | 9/1983 | Pike | 206/219 |
| 4,458,811 | A | * | 7/1984 | Wilkinson | 206/219 |
| 4,534,509 | A | * | 8/1985 | Holzner | 239/34 |
| 5,207,320 | A | * | 5/1993 | Allen | 206/220 |
| 7,097,075 | B2 | * | 8/2006 | Peuker et al. | 222/94 |
| 7,357,248 | B2 | * | 4/2008 | Sivakumar et al. | 206/219 |

(Continued)

FOREIGN PATENT DOCUMENTS

| | | |
|---|---|---|
| JP | 10-234820 | 9/1998 |
| WO | 2010/010866 | 1/2010 |

*Primary Examiner* — Steven A. Reynolds
*Assistant Examiner* — Javier A Pagan
(74) *Attorney, Agent, or Firm* — Rankin, Hill & Clark LLP

(57) ABSTRACT

A container for an orally ingested pharmaceutical composition has, in a container body, a pharmaceutical composition chamber, a chamber for an auxiliary substance for the pharmaceutical composition chamber, and a chamber for the auxiliary substance for a cap. The container for an orally ingested pharmaceutical composition is provided with said cap in addition to a container body. An inter-chamber portion seals the pharmaceutical composition chamber from the chamber for the auxiliary substance for the chamber. A boundary portion seals the chamber for the cap auxiliary substance from the inside of the cap. By the inter-chamber portion and the boundary portion being bent, one end of the container body is removably inserted into the cap.

2 Claims, 13 Drawing Sheets

(56) References Cited

U.S. PATENT DOCUMENTS 8,157,783 B2 * 4/2012 Yoshikawa ..... 604/410
2007/0119862 A1 * 5/2007 Backes et al. ..... 222/94
2008/0113019 A1 * 5/2008 Satokawa et al. ..... 424/451

* cited by examiner

Fig.7

| | | Type A | Type B |
|---|---|---|---|
| | | Mass (kg) | Mass (kg) |
| Flat mounting | | 2.1 | 2.1 |
| | | 3.2 | 3.2 |
| | | 2.6 | 2.6 |
| | | 1.8 | 1.8 |
| | | 2.4 | 2.4 |
| | Average value | 2.4 | 2.4 |
| | Maximum value | 3.2 | 3.2 |
| | Minimum value | 1.8 | 1.8 |
| Inter-chamber section double-folded | | 2.5 | 22.5 |
| | | 11.5 | 52.5 |
| | | 2.5 | 107.5 |
| | | 5.0 | 52.5 |
| | | 2.5 | 39.5 |
| | Average value | 4.8 | 54.9 |
| | Maximum value | 11.5 | 107.5 |
| | Minimum value | 2.5 | 22.5 |
| Arched | | 17.0 | 82.5 |
| | | 26.5 | 40.5 |
| | | 15.0 | 102.5 |
| | | 10.5 | 65.5 |
| | | 12.5 | 72.5 |
| | Average value | 16.3 | 72.7 |
| | Maximum value | 26.5 | 102.5 |
| | Minimum value | 10.5 | 40.5 |
| Storage chamber double-folded | | 110.0 | 92.5 |
| | | 110.0 | 92.5 |
| | | 110.0 | 77.5 |
| | | 110.0 | 77.5 |
| | | 110.0 | 110.0 |
| | Average value | 110.0 | 90.0 |
| | Maximum value | 110.0 | 110.0 |
| | Minimum value | 110.0 | 77.5 |

CONTAINER FOR ORALLY INGESTED PHARMACEUTICAL COMPOSITION

TECHNICAL FIELD

This invention relates to a container for orally ingested pharmaceutical composition, in particular to a container for orally ingested pharmaceutical composition which allows reducing the resistance of the patient against swallowing and which allows keeping down the possibility that the portions between the spaces open up because of force majeure, accidental events, age deterioration or incorrect handling.

BACKGROUND ART

Patent document 1 discloses a multi-chamber container. The multi-chamber container is partitioned into a plurality of spaces in such a manner that the plurality of spaces can be interconnected with each other. The spaces are sealed in such a state that the spaces can be interconnected with each other by means of force applied from the outside. A granular agent is stored in a tightly sealed state in any of the spaces. A thick fluid substance is stored in a tightly sealed state in one or more other spaces. After interconnecting the spaces and gathering and mixing the granular agent with the thick fluid substance, it is possible to take out the mixture from a take-out port provided on any of the spaces.

According to the container disclosed in patent document 1, it is possible to ingest a granular agent by means of an extremely simple operation. Moreover, according to the multi-chamber container disclosed in patent document 1, it is possible to significantly reduce the resistance of the patient against swallowing.

PRIOR ART DOCUMENTS

Patent Documents

Patent document 1: Japanese Patent Laid-Open No. 10-234820

BRIEF SUMMARY OF THE INVENTION

Problem to Be Solved By the Invention

However, the invention disclosed in patent document 1 leaves room for improving the ease of use. The following explains the problem.

The spaces of the multi-chamber container disclosed in patent document 1 (below simply referred to as "multi-chamber container") can be interconnected by force applied from outside. For this reason, there is the risk that the portions between the spaces open up because of force majeure, accidental events, age deterioration or incorrect handling while the multi-chamber container with no granular agent inside is stored. If any of the portions between the spaces opens up, the multi-chamber container will not be usable any more. An example for force majeure is vibration during transport. An example for accidental events is the shock that is received if the container is dropped during storage. An example for age deterioration is the deterioration of the adhered portions of the multi-chamber container during storage. An example for incorrect handling is that the containers are bundled, placed in a bag or the like and then mistakenly stepped on.

This invention was made in order to solve such problem, and the purpose thereof is to provide a container for orally ingested pharmaceutical composition which allows reducing the resistance of the patient against swallowing and which allows lowering the possibility that the portions between the spaces open up because of force majeure, accidental events, age deterioration or incorrect handling. Note that the term "pharmaceutical composition" as mentioned in the following explanations shall be a general name for medicine and food.

Means for Solving the Problem

The container for orally ingested pharmaceutical composition of this invention is explained in reference to the drawings.

Note that the use of the reference numerals of the drawings in this column is intended to facilitate the understanding of the content of the invention and is not intended to limit the content to the scope indicated.

According to the aspects of this invention to achieve the abovementioned purpose, the containers 400, 600 and 700 for orally ingested pharmaceutical composition are provided with container bodies 402 and 610 and with a plurality of spaces 420, 422, 424, 620, 622 and 624 therein. Any one of the spaces is the pharmaceutical composition storage chamber 422 or 620. A pharmaceutical composition is stored in the pharmaceutical composition storage chambers 422 and 620. Any one of the spaces is the storage-chamber aid substance chamber 420 or 622. The storage-chamber aid substance chambers 420 and 622 are adjacent to the pharmaceutical composition storage chambers 422 and 620. The swallowing aid substance 40 is stored in the storage-chamber aid substance chambers 420 and 622. The container bodies 402 and 610 are provided with predetermined aperture sections 447 and 630. The predetermined aperture sections 447 and 630 are portions where an aperture is to be formed. The aperture interconnects the outside of the container bodies 402 and 610 with the pharmaceutical composition storage chambers 422 and 620. Of the container bodies 402 and 610, the inter-chamber sections 441 and 640, which seal the portions between the pharmaceutical composition storage chambers 422 and 620 and the storage-chamber aid substance chambers 420 and 622, open up when force is applied from the outside of the container bodies 402 and 610. On the container bodies 402 and 610, at least one of any one of inter-chamber sections 441 and 640 or any one of the storage-chamber aid substance chambers 420 and 622 is provided with a flexible section 676. The flexible section 676 is bent.

Because the flexible section 676 is bent, the swallowing aid substance 40 is prevented from passing through the flexible section 676. Thereby the force of the swallowing aid substance 40 trying to expand the inter-chamber sections 441 and 640 is smaller compared to the case where the inter-chamber sections 441 and 640 and the storage-chamber aid substance chambers 420 and 622 are straight. As a result, it is possible to lower the possibility that the inter-chamber sections 441 and 640 open up because of force majeure, accidental events, age deterioration or incorrect handling.

Further, in addition to the container body 402, it is preferable that the abovementioned container 400 for orally ingested pharmaceutical composition is equipped with a cap section 404 which is integrally provided on the container body 402. In this case, the container body 402 comprises at least three spaces 420, 422 and 424. Any one of the spaces is the cap-section aid substance chamber 424. The cap-section aid substance chamber 424 is adjacent to the cap section 404. The swallowing aid substance 40 is pre-stored in the cap-section aid substance chamber 424. In this case, the three or more spaces 420, 422 and 424, and the cap section 404 are arranged so as to form one line. In this case, in addition to the inter-chamber section 441, the boundary section 445 which seals the portion between the cap-section aid substance chamber 424 and the inside of the cap-section 404, opens up when force is applied from the outside of the container body 402. In this case, the inter-chamber section 441 and the boundary section 445 are flexible. The inter-chamber section 441 and the boundary section 445 are bent to removably insert the one of the two ends of the container body 402 that is on the opposite side of where the cap section 404 is provided, into the cap section 404.

In the container 400 for orally ingested pharmaceutical composition, the inter-chamber section 441 and the boundary section 445 are bent. Thereby, the inter-chamber section 441 and the boundary section 445 are sealed more firmly than in the case where the inter-chamber section 441 and the boundary section 445 are straight. Because the inter-chamber section 441 and the boundary section 445 are firmly sealed, it is possible to lower the possibility that the inter-chamber section 441 and the boundary section open up because of force majeure, accidental events, age deterioration or incorrect handling.

It frequently happens that a patient must swallow two or more types of pharmaceutical composition. From these pharmaceutical compositions, the one that is stored in the multi-chamber container disclosed in patent document 1 can be swallowed with an extremely simple operation, and it is possible to reduce the resistance of the patient against swallowing significantly. However, those of the pharmaceutical compositions that are not stored in the multi-chamber container must be swallowed by being received on the tongue for a moment and then being swallowed with water or the like. De facto, this renders the use of the multi-chamber container meaningless. It would also be possible to prepare a thick fluid substance other than the one stored in the multi-chamber container and use such thick fluid substance to take the pharmaceutical composition. However, the work to prepare such thick fluid substance is extremely troublesome. It would also be possible to store the prepared thick fluid substance filled into bags. However, in this case, the patient must receive the pharmaceutical composition on the tongue for a moment to swallow the pharmaceutical composition. For this reason, it is not possible to reduce the resistance of the patient against swallowing.

In contrast hereto, the container for orally ingested pharmaceutical composition 400 of this invention is provided with a boundary section 445 between the cap-section aid substance chamber 424 and the cap section 404. When force is applied to the swallowing aid substance 40 from the outside of the container body 402, the boundary section 445 is opened up by the swallowing aid substance 40 that received such force. Thereby, to swallow a pharmaceutical composition that is not stored in the pharmaceutical composition storage chamber 422, the pharmaceutical composition will enter the mouth of the patient together with the swallowing aid substance 40 in the cap-section aid substance chamber 424 if a person temporarily fills the pharmaceutical composition into the cap section 404, lets the patient hold the cap section 404 in his or her mouth and applies force to the swallowing aid substance 40 from the outside of the container body 402. As a consequence, it becomes unnecessary to place the pharmaceutical composition onto the tongue for a moment. Because it becomes unnecessary to place the pharmaceutical composition onto the tongue for a moment, it is possible to significantly reduce the resistance of the patient against swallowing. Moreover, it becomes unnecessary to prepare an additional swallowing aid substance 40 for swallowing a pharmaceutical composition that is not stored in the container 400 for orally ingested pharmaceutical composition. The operation for swallowing a pharmaceutical composition other than the pharmaceutical composition that is pre-stored inside can thus be simplified by the elimination of that step.

Further, in addition to the container body 610, it is preferable that the abovementioned containers 600 and 700 for orally ingested pharmaceutical composition are equipped with a passage section 612 which is integrally provided in the container body 610. In this case, the container body 610 comprises at least three spaces 620, 622 and 624. Any one of the spaces is the universal aid substance chamber 624. The universal aid substance chamber 624 is adjacent to the passage section 612. The swallowing aid substance 40 is pre-stored inside the universal aid substance chamber 624. In this case, in addition to the inter-chamber section 640, the boundary section 644 which seals the portion between the universal aid substance chamber 624 and the inside of the passage section 612 opens up when force is applied from the outside of the container body 610. In this case, the passage section 612 serves as a passage for the swallowing aid substance 40 inside the universal aid substance chamber 624 when the boundary section 644 is opened. The boundary section 644 is flexible, and is bent.

As mentioned above, it is not possible to reduce the resistance of the patient against swallowing if the patient must swallow two or more types of pharmaceutical composition.

In contrast hereto, the containers 600 and 700 for orally ingested pharmaceutical composition of this invention are provided with a boundary section 644 between the universal aid substance chamber 624 and the passage section 612. When force is applied to the swallowing aid substance 40 from the outside of the container body 610, the boundary section 644 is opened up by the swallowing aid substance 40 that received such force. Thereby, to swallow a pharmaceutical composition that is not stored in the pharmaceutical composition storage chamber 620, the pharmaceutical composition will enter the mouth of the patient together with the swallowing aid substance 40 in the universal aid substance chamber 624 if a person temporarily fills the pharmaceutical composition into the passage section 612, lets the patient hold the passage section 612 in his or her mouth and applies force to the swallowing aid substance 40 from the outside of the container body 610. As a consequence, it becomes unnecessary to place the pharmaceutical composition onto the tongue for a moment. Because it becomes unnecessary to place the pharmaceutical composition onto the tongue for a moment, it is possible to significantly reduce the resistance of the patient against swallowing. Moreover, it becomes unnecessary to prepare a new swallowing aid substance 40 for swallowing a pharmaceutical composition that is not stored in the containers 600 and 700 for orally ingested pharmaceutical composition. The operation for swallowing a pharmaceutical composition other than the pharmaceutical composition that is pre-stored inside can thus be simplified by the elimination of that step.

Moreover, it is preferable that a flexible section 676 is provided in any position of the abovementioned storage-chamber aid substance chamber 622.

Effect of the Invention

According to this invention, it is possible to reduce the resistance of the patient against swallowing and to lower the possibility that the portions between the spaces open up because of force majeure, accidental events, age deterioration or incorrect handling.

BRIEF DESCRIPTION OF THE DRAWINGS

FIG. 7 shows the results of the load bearing test.

MODES FOR CARRYING OUT THE INVENTION

Figure 1:
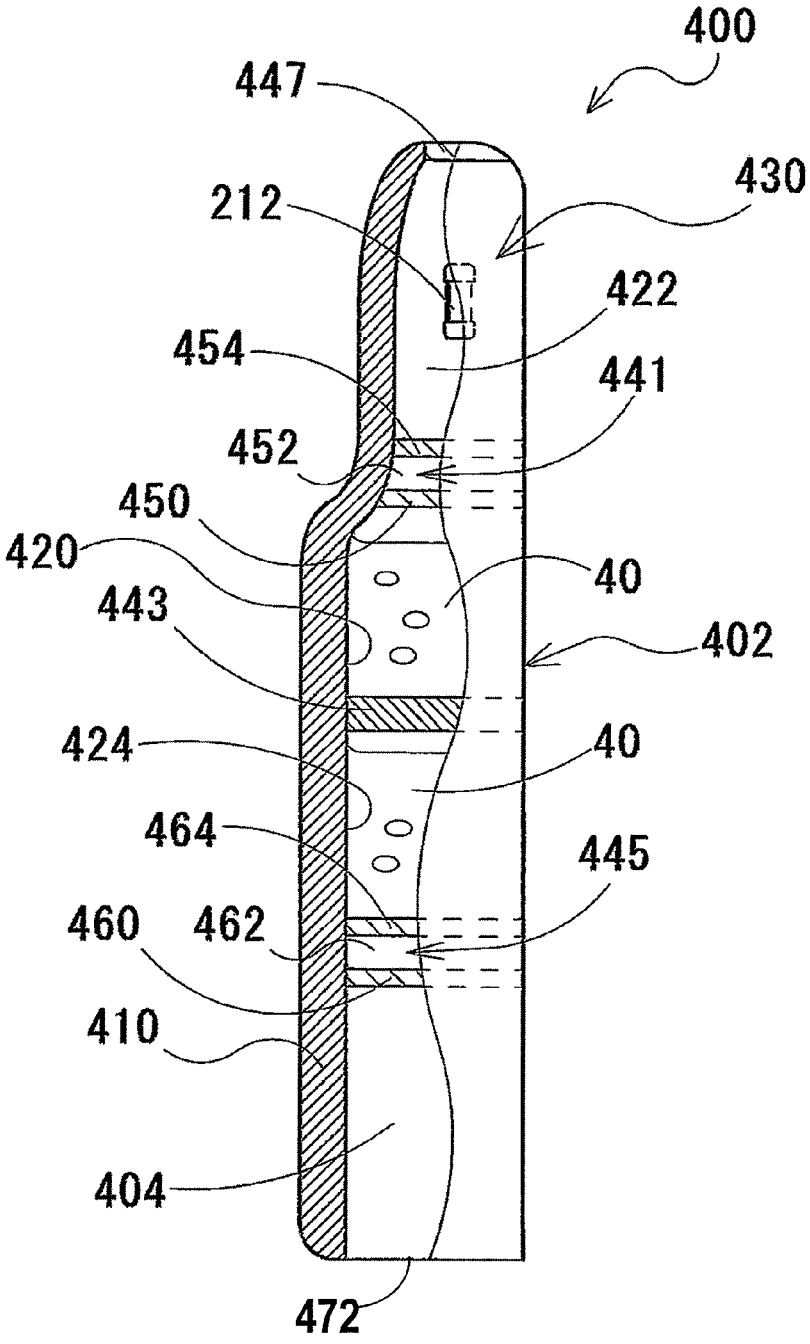
FIG. 1 is a partial cross section of the pharmaceutical composition container of the embodiment 1 of this invention.

The following explains the embodiments of this invention on the basis of the drawings. In the following explanations, identical parts are assigned the same reference numeral. The names and functions thereof are also the same. Accordingly, detailed explanations thereof will not be repeated.

Embodiment 1

The following explains embodiment 1 of this invention.

<Explanation of the Structure>

FIG. 1 is a partial cross section of the pharmaceutical composition container 400 of this embodiment. The portion of the pharmaceutical composition container 400 where the ends of the sheet are adhered to each other is the side strong seal 410.

The pharmaceutical composition container 400 is equipped with a container body 402 and a cap section 404. The container body 402 comprises at least three spaces (in the case of this embodiment, exactly three spaces when not considering the intermediate chambers 452 and 462 mentioned later) therein. The cap section 404 is disposed on one end of the container body 402 and is integrated with the container body 402.

The portions between the spaces inside the abovementioned container body 402 are sealed by the inter-chamber section 441 and the inter-chamber strong seal section 443. The inter-chamber section 441 comprises a first zone 450, an intermediate chamber 452 and a second zone 454.

One of the spaces inside the container body 402 is the storage-chamber aid substance chamber 420. A swallowing aid substance 40 is stored inside the storage-chamber aid substance chamber 420. When force is applied to the swallowing aid substance 40 from the outside of the pharmaceutical composition container 400, the first zone 450 of the inter-chamber section 441 easily opens by means of the pressure from the swallowing aid substance 40. When the first zone 450 opens, the swallowing aid substance 40 is pushed into the intermediate chamber 452. In the same manner, the second zone 454 opens. This can be realized because the strength of the first zone 450 and the second zone 454 is weak compared to the strength of the side strong seal 410 and the inter-chamber strong seal section 443.

One of the spaces inside the container body 402 is the pharmaceutical composition storage chamber 422. An encapsulating item 212 is stored herein. The encapsulating item 212 encapsulates a pharmaceutical composition, which is not shown in the drawings. One end of the pharmaceutical composition storage chamber 422 is sealed by the predetermined aperture section 447. The strength of the predetermined aperture section 447 is weak compared to the strength of the side strong seal 410 and the inter-chamber strong seal section 443. For this reason, the predetermined aperture section 447 opens by the pressure received from the swallowing aid substance 40 when the container body 402 is squeezed from the inter-chamber strong seal section 443 towards the predetermined aperture section 447 while the swallowing aid substance 40 is inside the pharmaceutical composition storage chamber 422.

One of the spaces inside the container body 402 is the cap-section aid substance chamber 424. A swallowing aid substance 40 is stored also inside the cap-section aid substance chamber 424 in the same manner as in the storage-chamber aid substance chamber 420. The portion between the cap-section aid substance chamber 424 and the storage-chamber aid substance chamber 420 is sealed by the inter-chamber strong seal section 443. The strength of the inter-chamber strong seal section 443 is the same as that of the side strong seal 410; therefore the inter-chamber strong seal section 443 is not broken even when force is applied to the swallowing aid substance 40 from the outside of the pharmaceutical composition container 400.

Meanwhile, the cap-section aid substance chamber 424 is adjacent to the cap section 404. The portion between the cap-section aid substance chamber 424 and the inside of the cap section 404 is sealed by the boundary section 445. The boundary section 445 comprises a first zone 460, an intermediate chamber 462 and a second zone 464. The strength of the first zone 460 and the second zone 464 is weak compared to the strength of the side strong seal 410 and the inter-chamber strong seal section 443. Thereby, the first zone 460 and the second zone 464 of the boundary section 445 easily open in a sequential manner by means of the pressure received from the swallowing aid substance 40 when force is applied to the swallowing aid substance 40 inside the cap-section aid substance chamber 424 from the outside of the pharmaceutical composition container 400.

<Explanation of the Production Process>

The production process for the pharmaceutical composition container 400 of this embodiment is as follows.

First, a sheet made of a synthetic resin (low-density polyethylene, PET (polyethylene terephthalate) or another resin that is soft so as to be bendable/foldable and is heat-sealable, like composite resin), is double-folded, and the ends of the double-folded sheet are adhered to each other. Because the material of the pharmaceutical composition container 400 is soft, the inter-chamber section 441 and the boundary section 445 are flexible. When the ends of the sheet are adhered to each other, the adhering of the inner surfaces of the sheet to each other, the filling of the swallowing aid substance 40 and the insertion of the encapsulating item 212 are repeated. Thereby, the storage-chamber aid substance chamber 420, the inter-chamber section 441, the pharmaceutical composition storage chamber 422, the predetermined aperture section 447, the inter-chamber strong seal section 443, the cap-section aid substance chamber 424, the boundary section 445 and the cap section 404 are sequentially formed. After the above are formed, the portion of the double-folded sheet that was adhered to each other is trimmed to align the outer shape. By the abovementioned method, the swallowing aid substance 40 is filled into the storage-chamber aid substance chamber 420 after the storage-chamber aid substance chamber 420 is formed. After the storage-chamber aid substance chamber 420 is tightly sealed, the pharmaceutical composition storage chamber 422 is formed. After the pharmaceutical composition storage chamber 422 is formed, an encapsulating item 212 is stored therein. After the encapsulating item 212 is stored in the pharmaceutical composition storage chamber 422, the predetermined aperture section 447 is formed. After the cap-section aid substance chamber 424 is formed, the swallowing aid substance 40 is filled thereinto. After the cap-section aid substance chamber 424 is tightly sealed, the boundary section 445 is formed. Thereby, it is possible to easily form spaces and to insert items into the formed spaces in a sequential manner. Because the above can be easily formed in a sequential manner, it is easy to produce the pharmaceutical composition container 400.

Figure 2:
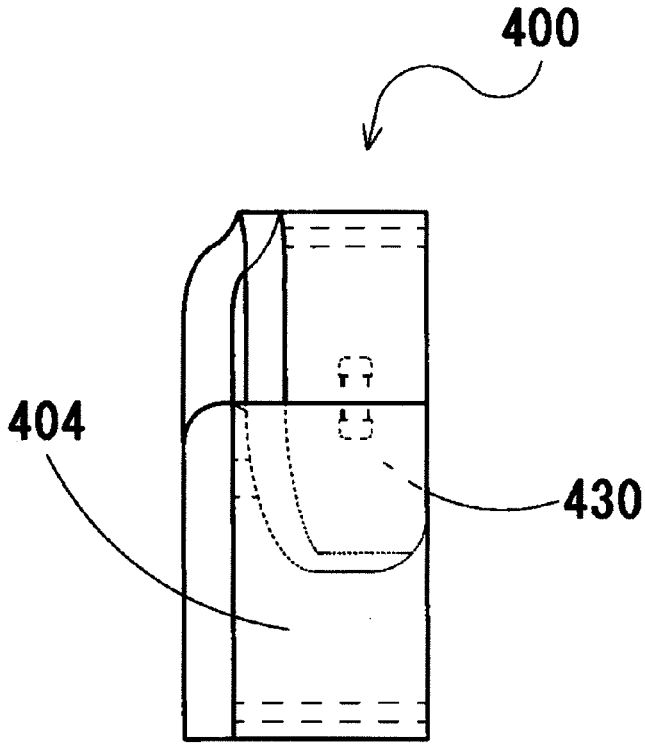
FIG. 2 shows the state of the embodiments of this invention when the tip portion of the pharmaceutical composition container is inserted into the cap section.

After the outer shape is finished, the inter-chamber section 441 and the boundary section 445 are bent, and the tip portion 430 (the portion including the one of the two ends of the container body 402 that is on the opposite side of the end where the cap section 404 is provided) is inserted into the cap section 404. FIG. 2 shows the state in which the tip portion 430 is inserted into the cap section 404. When the tip portion 430 is inserted into the cap section 404, the pharmaceutical composition container 400 is placed in a package and shipped.

<Usage Method>

To use the pharmaceutical container 400 of this embodiment, the patient or caretaker first pulls out the tip portion 430 from the cap section 404. When the tip portion 430 is pulled out of the cap section 404, the patient or caretaker places the tip portion 430 into the mouth of the patient. When the tip portion 430 is inserted into the mouth of the patient, the patient or caretaker applies force to the portion of the container body 402 where the storage-chamber aid substance chamber 420 is formed, to open the inter-chamber section 441. When the inter-chamber section 441 is open, the patient or caretaker squeezes the pharmaceutical composition container 400 from the storage-chamber aid substance chamber 420 towards the predetermined aperture section 447. As a result, the predetermined aperture section 447 opens and the swallowing aid substance 40 and the encapsulating item 212 (in other words, the pharmaceutical composition) enter the mouth of the patient.

When the swallowing aid substance 40 and the encapsulating item 212 enter the mouth of the patient, the patient or caretaker pulls the tip portion 430 out of the mouth of the patient and inserts another pharmaceutical composition into the cap section 404. When the other pharmaceutical composition is inside the cap section 404, the patient or caretaker lets the patient hold the cap section 404 in his or her mouth. When the patient holds the cap section 404 in his or her mouth, the patient or caretaker applies force to the portion of the container body 402 where the cap aid substance chamber 424 is formed, to open the boundary section 445. When the boundary section 445 opens, the swallowing aid substance 40 inside the cap aid substance chamber 424 enters the mouth of the patient together with the pharmaceutical composition inside the cap section 404.

Special Notes on the Pharmaceutical Composition Container of this Embodiment

Special notes to be given on the pharmaceutical composition container 400 of this embodiment are as follows. The first is that, when the tip portion 430 is inserted into the cap section 404, the inter-chamber section 441 and the boundary section 445 are bent. The second is that the cap section 404 is provided so as to be adjacent to the cap-section aid substance chamber 424, and that the boundary section 445 is provided between the cap aid substance chamber 424 and the cap section 404.

<Explanation of the Effect>

As mentioned above, the inter-chamber section 441 and the boundary section 445 in the pharmaceutical composition container 400 are bent. Thereby, the inter-chamber section 441 and the boundary section 445 are sealed more firmly than in the case where the inter-chamber section 441 and the boundary section 445 are straight. Because the inter-chamber section 441 and the boundary section 445 are firmly sealed, it is possible to lower the possibility that the inter-chamber section 441 and the boundary section 445 spontaneously open during storage. Further, it is possible to lower the possibility that the inter-chamber sections 441 and 640 open up because of force majeure, accidental events occurring during transport or the like, or incorrect handling.

Further, as mentioned above, the portion between the cap-section aid substance chamber 424 and the cap section 404 in the pharmaceutical composition container 400 of this embodiment is sealed by the boundary section 445. When force is applied to the swallowing aid substance 40 from the outside of the container body 402, the boundary section 445 is opened up by the swallowing aid substance 40 that received such force. Thereby, when a pharmaceutical composition that is not stored in the pharmaceutical composition storage chamber 422 is swallowed, the pharmaceutical composition will enter the mouth of the patient together with the swallowing aid substance 40 in the cap-section aid substance chamber 424 if the pharmaceutical composition is temporarily filled into the cap section 404, the patient holds the cap section 404 in his or her mouth, and the pharmaceutical composition container 400 is squeezed. As a consequence, it becomes unnecessary to place the pharmaceutical composition onto the tongue for a moment. Because it becomes unnecessary to place the pharmaceutical composition onto the tongue for a moment, it is possible to significantly reduce the resistance of the patient against swallowing.

Embodiment 2

The following explains embodiment 2 of this invention. Note that items which are identical with those explained in embodiment 1 are given identical reference numerals. In this embodiment, the detailed explanation thereof will not be repeated.

<Explanation of the Structure>

Figure 3:
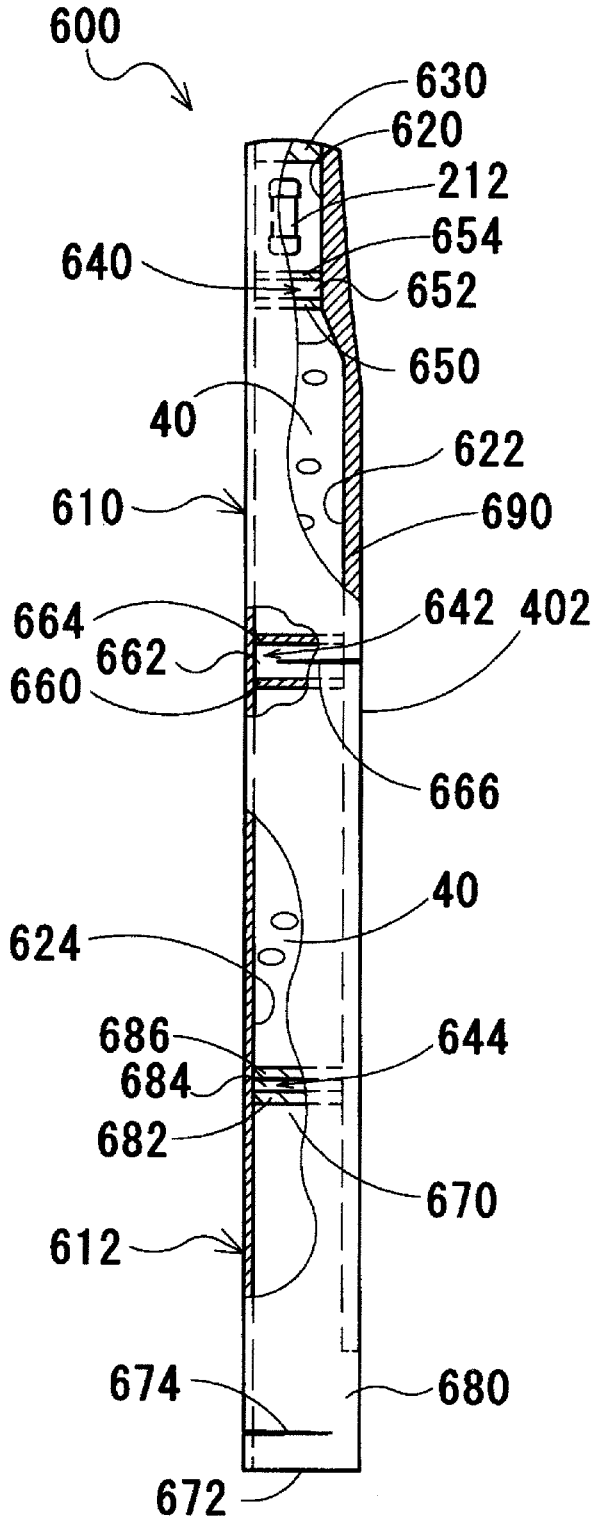
FIG. 3 is a partial cross section of the pharmaceutical composition container of the embodiment 2 of this invention.

FIG. 3 is a partial cross section of the pharmaceutical composition container 600 of this embodiment. The portion of the pharmaceutical composition container 600 where the ends of the sheet are adhered to each other is the side strong seal 690.

The pharmaceutical composition container 600 is equipped with a container body 610 and a passage section 612.

The container body 610 comprises at least three spaces (in the case of this embodiment, exactly three spaces when not considering the intermediate chambers 652, 662 and 684 mentioned later) therein. The passage section 612 is provided on one end of the container body 610 and is integrated with the container body 610.

First, the container body 610 will be explained. One of the spaces inside the container body 610 is the storage-chamber aid substance chamber 622. A swallowing aid substance 40 is stored inside the storage-chamber aid substance chamber 622.

One of the spaces inside the container body 610 is the pharmaceutical composition storage chamber 620. An encapsulating item 212 is stored herein. The storage-chamber aid substance chamber 622 is adjacent to the pharmaceutical composition storage chamber 620. One end of the pharmaceutical composition storage chamber 620 is sealed by the predetermined aperture section 630. The strength of the predetermined aperture section 630 is weak compared to the strength of the side strong seal 690.

One of the spaces inside the container body 610 is the universal aid substance chamber 624. A swallowing aid substance 40 is stored also inside the universal aid substance chamber 624 in the same manner as in the storage-chamber aid substance chamber 622.

In the abovementioned container body 610, the portion between the pharmaceutical composition storage chamber 620 and the storage-chamber aid substance chamber 622 is sealed by the inter-chamber section 640. The inter-chamber section 640 comprises a first zone 650, an intermediate chamber 652 and a second zone 654. The strength of the first zone 650 and the second zone 654 is weak compared to the strength of the side strong seal 690. Thereby, the first zone 650 and the second zone 654 easily open in a sequential manner by means of the pressure received from the swallowing aid substance 40 when force is applied to the swallowing aid substance 40 inside the storage-chamber aid substance chamber 622 from the outside of the pharmaceutical composition container 600.

In the abovementioned container body 610, the portion between the pharmaceutical composition storage chamber 622 and the universal aid substance chamber 624 is sealed by the inter-chamber section 642. The inter-chamber seal section 642 comprises a first zone 660, an intermediate chamber 662 and a second zone 664. The strength of the first zone 660 and the second zone 664 is weak compared to the strength of the side strong seal 690. Thereby, the first zone 660 and the second zone 664 do not open at least until the first zone 682 and the second zone 686 mentioned later open, even if force is applied to the swallowing aid substance 40 inside the universal aid substance chamber 624 from the outside of the pharmaceutical composition container 600. Note that, in the case of this embodiment, the inter-chamber strong seal section 642 is provided with a body-side incision 666.

Further, one end of the universal aid substance chamber 624 is provided with a boundary section 644. The boundary section 644 seals one end of the universal aid substance chamber 624. The boundary section 644 comprises a first zone 682, an intermediate chamber 684 and a second zone 686. The strength of the first zone 682 and the second zone 686 is weak compared to the strength of the side strong seal 690. Thereby, the first zone 682 and the second zone 686 easily open in a sequential manner by means of the pressure received from the swallowing aid substance 40 when force is applied to the swallowing aid substance 40 inside the universal aid substance chamber 624 from the outside of the pharmaceutical composition container 600.

Next, the passage section 612 will be explained. The passage section 612 is positioned so as to be adjacent to the boundary section 644. The passage section 612 serves as a passage for the swallowing aid substance 40 inside the universal aid substance chamber 624 when the boundary section 644 is opened.

The passage section 612 comprises a counter mouth section 670, a pass-through mouth section 672 and a folding margin 680. The counter mouth section 670 is provided on the one of the two ends of the passage section 612 that is opposite to the boundary section 644. The counter mouth section 670 serves as the entrance for the swallowing aid substance 40 when the swallowing aid substance 40 is discharged from inside the universal aid substance chamber 624 and enters the passage section 612. The pass-through mouth section 672 is provided on the one of the two ends of the passage section 612 that is opposite to the counter mouth section 670. The pass-through mouth section 672 serves as the exit for the swallowing aid substance 40 that passes through the counter mouth section 670 and as the entrance for the pharmaceutical composition. The pharmaceutical composition is different from the pharmaceutical composition stored in the encapsulating item 212 inside the pharmaceutical composition storage chamber 620. The folding margin 680 is for folding over a part of the edge of the pass-through mouth section 672. Note that, in the case of this embodiment, the passage section 612 is provided with a passage-side incision 674.

Same as in the embodiment 1, the pharmaceutical composition container 600 of this embodiment is also formed by double-folding one foldable sheet and adhering the surfaces of the sheet to each other. For this reason, the pass-through mouth section 672 is also formed by aligning the surfaces of a foldable sheet so as to face each other and adhering the surfaces to each other.

The folding margin 680 in this embodiment is a portion where the sheet surfaces are not adhered, and corresponds to the edge of the sheet and the edge of the pass-through mouth section 672.

<Explanation of the Production Process>

In the manufacturing process for the pharmaceutical composition container 600 of this embodiment, the process until the outer shape is finished is the same as in embodiment 1; therefore a detailed explanation thereof will not be repeated here. The following explains the process after the outer shape is finished.

Figure 4:
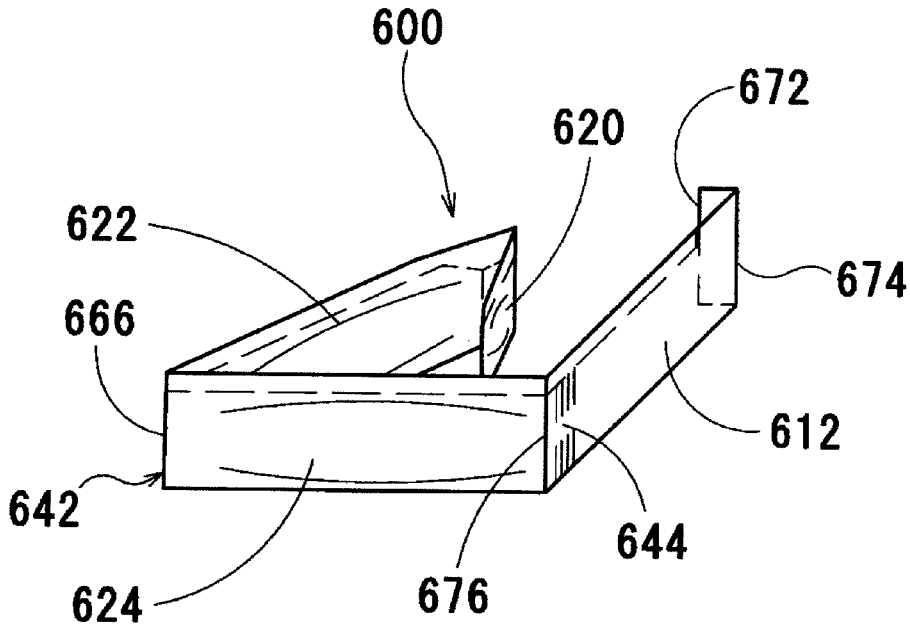
FIG. 4 is a conceptual diagram showing the state in which the pharmaceutical composition container of the embodiment 2 of this invention is being folded up.
Figure 5:
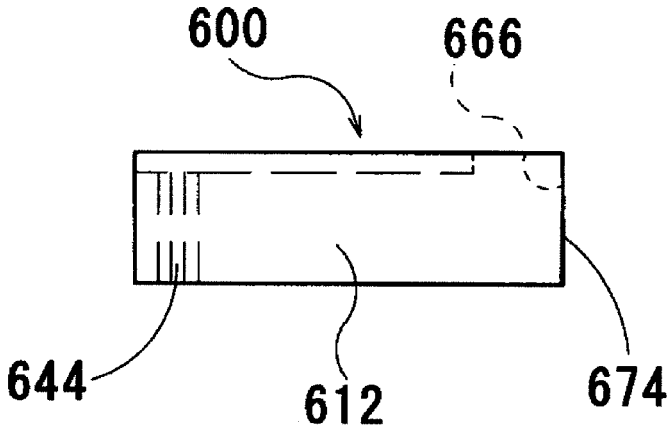
FIG. 5 is an external view showing the pharmaceutical composition container of the embodiment 2 of this invention while the body-side incision and the passage-side incision are engaged with each other.
Figure 6A:
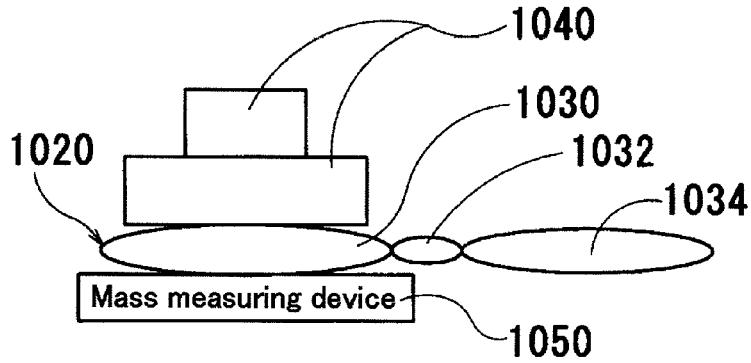
FIG. 6 is a conceptual diagram showing how the test container is mounted.
Figure 6B:
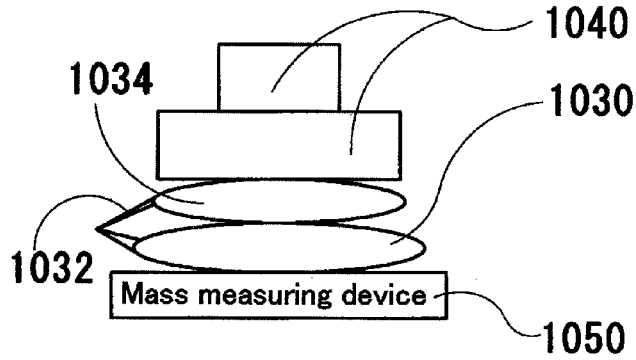
Figure 6C:
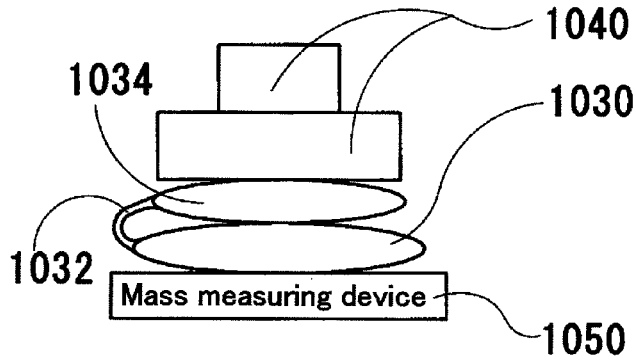
Figure 6D:
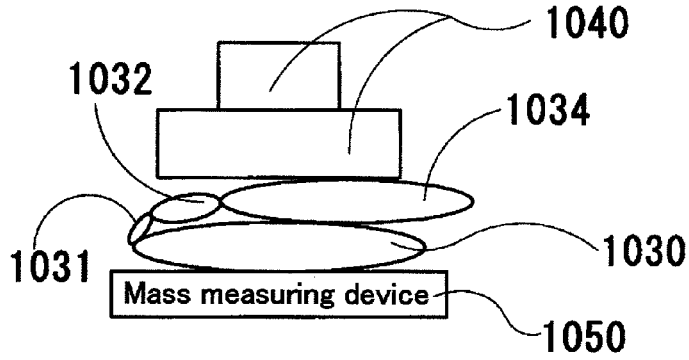

When the outer shape of the pharmaceutical composition container 600 is finished, the pharmaceutical composition container 600 is bent into a U-shape. In addition, the two portions that correspond to the tips of the "U" are folded so as to oppose each other. When the portions corresponding to the two tips of the "U" are folded, the portion corresponding to the curve of the "U" is bent. FIG. 4 is a conceptual diagram showing the pharmaceutical composition container 600 while being folded up. In the case of this embodiment, the bending section 676 and the inter-chamber strong seal section 642, which correspond to the ends of the universal aid substance chamber 624, are folded. In the case of this embodiment, the entirety of the pharmaceutical composition container 600 is flexible. For this reason, the bending section 676 and the inter-chamber strong seal section 642 are also flexible. Thereby the pharmaceutical composition container 600 is folded up. In the case of this embodiment, at least one of the pharmaceutical composition storage chamber 620 and the storage-chamber aid substance chamber 622 is in contact with the universal aid substance chamber 624. The passage section 612 overlaps with the storage-chamber aid substance chamber 622. When the pharmaceutical composition container 600 is folded up, the body-side incision 666 and the passage-side incision 674 are engaged with each other. FIG. 5 is an external view of the pharmaceutical composition container 600 when the body-side incision 666 and the passage-side incision 674 are engaged with each other. The pharmaceutical composition container 600 of this embodiment is placed in a box, which is not shown in the drawings, for distribution in this state.

<Usage Method>

Except that, first, the body-side incision 666 and the passage-side incision 674 are released from the engagement, the usage method for the pharmaceutical composition container 600 of this embodiment is the same as that of embodiment 1; therefore a detailed explanation thereof will not be repeated here.

Special Notes on the Pharmaceutical Composition Container of this Embodiment

Special notes to be given on the pharmaceutical composition container 600 of this embodiment are as follows. The first is that a passage section 612 is provided. The second is that a folding margin 680 is provided. The third is that a portion where the sheet surfaces are not adhered to each other and that corresponds to the edge of the sheet and the edge of the pass-through mouth section 672, is used as the folding margin 680. The fourth is that the pharmaceutical composition container 600 is folded at the bending section 676 and the inter-chamber strong seal section 642. The fifth is that the pharmaceutical composition storage chamber 620 and the storage-chamber aid substance chamber 622 are covered by the universal aid substance chamber 624 and the passage section 612. The sixth is that this cover state is not easily released due to the engagement of the body-side incision 666 with the passage-side incision 674.

<Explanation of the Effect>

As mentioned above, the pharmaceutical composition container 600 of this embodiment is equipped with a passage section 612. Thereby, for the same reason as for the cap section 404 of the pharmaceutical composition container 400 in embodiment 1, it is possible to reduce the resistance of the patient against swallowing.

Further, as mentioned above, the pharmaceutical composition container 600 of this embodiment is equipped with a folding margin 680. Because the folding margin 680 is provided, it becomes possible to fold over a part of the edge of the pass-through mouth section 672 from said folding margin 680. Folding over a part of the edge of the pass-through mouth section 672 allows expanding the mouth of the pass-through mouth section 672. Because it is possible to expand the mouth of the pass-through mouth section 672, the pharmaceutical composition can be filled in more easily.

Further, as mentioned above, the folding margin 680 is a portion where the sheet surfaces are not adhered to each other, and corresponds to the edge of the sheet and the edge of the pass-through mouth section 672. For this reason, it becomes possible to form the folding margin 680 by not adhering said portion. When forming the folding margin 680 in this manner, the following effect can be obtained as compared to the case where at least one of either a protrusion or an indent is provided on the portion corresponding to the edge of the pass-through mouth section 672 and said portion is used as the folding margin. The first effect is that it is possible to use the sheet more efficiently. The second effect is that the process of providing at least one of either a protrusion or an indent on the portion corresponding to the edge of the pass-through mouth section 672 becomes unnecessary.

Further, as mentioned above, the pharmaceutical composition container 600 of this embodiment is equipped with a body-side incision 666 and a passage-side incision 674. Because such incisions are provided, the cover state will not be easily released.

Further, as mentioned above, the pharmaceutical composition container 600 is folded at the bending section 676 and the inter-chamber strong seal section 642. Thereby, it is less likely that the swallowing aid substance leaks from the universal aid substance chamber 624. The following concretely explains the feature.

How resistant the inter-chamber section 640 and the boundary section 644 are against being opened can be estimated by investigating how much load is applied to the storage-chamber aid substance chamber 622 and the universal aid substance chamber 624 for the inter-chamber section 640 and the boundary section 644 to open. For this purpose, a load bearing test was performed according to the following procedure.

First, two test containers 1020 are produced. The test containers 1020 are made by double-folding one synthetic-resin sheet and adhering the surfaces thereof to each other. The container is provided with a first storage chamber 1030, a mock inter-chamber section 1032 and a second storage chamber 1034. The strength of the mock inter-chamber section 1032 is approximately the same as that of the inter-chamber section 640 and the boundary section 644. One of the produced test containers 1020 stores a swallowing aid substance 40 in each of the first storage chamber 1030 and the second storage chamber 1034. In the following explanations, this test container is referred to as "type A." The other of the test containers 1020 stores a swallowing aid substance 40 in the first storage chamber 1030. The second storage chamber 1034 is empty. In the following explanations, this test container is referred to as "type B."

When the test containers 1020 are completed, a test container 1020 is mounted on a common mass measuring device 1050. When the test container 1020 is mounted, a weight 1040 is mounted on top thereof. When the weight 1040 is mounted, it is observed whether the swallowing aid substance 40 leaks from the first storage chamber 1030. If the swallowing aid substance 40 does not leak, an additional weight 1040 is mounted on top of the test container 1020. If the swallowing aid substance 40 leaks, the mass shown by the mass measuring device 1050 at that time is read.

When the mass shown by the mass measuring device 1050 is read, the mass of the test container 1020 is subtracted from said mass to thereby calculate the total mass of the weights 1040 mounted on top of the test container 1020. Said mass is regarded as the load at which the inter-chamber section 640 or the boundary section 644 opens.

FIG. 6 is a conceptual diagram showing how the test container 1020 is mounted onto the mass measuring device 1050 and how the weights 1040 are mounted on the test container 1020. FIG. 6(A) shows the state in which the weights 1040 are mounted on top of the first storage chamber 1030 with the test container 1020 not being folded up. In the following explanations, this way of mounting the weights 1040 is referred to as "flat mounting." FIG. 6(B) shows the state in which the weights 1040 are mounted on top of the test container 1020 with the mock inter-chamber section 1032 firmly folded. In the following explanations, this way of mounting the weights 1040 is referred to as "inter-chamber section double-folded." FIG. 6(C) shows the state in which the weights 1040 are mounted on top of the test container 1020 while the mock inter-chamber section 1032 is bent in such a manner that there is no fold in the mock inter-chamber section 1032. In the s following explanations, this way of mounting the weights 1040 is referred to as "arched." FIG. 6(D) shows the state in which the weights 1040 are mounted on top of the test container 1020 with the end section 1031 of the first storage chamber 1030 being firmly bent. In the following explanations, this way of mounting the weights 1040 is referred to as "storage chamber double-folded."

Figure 8:
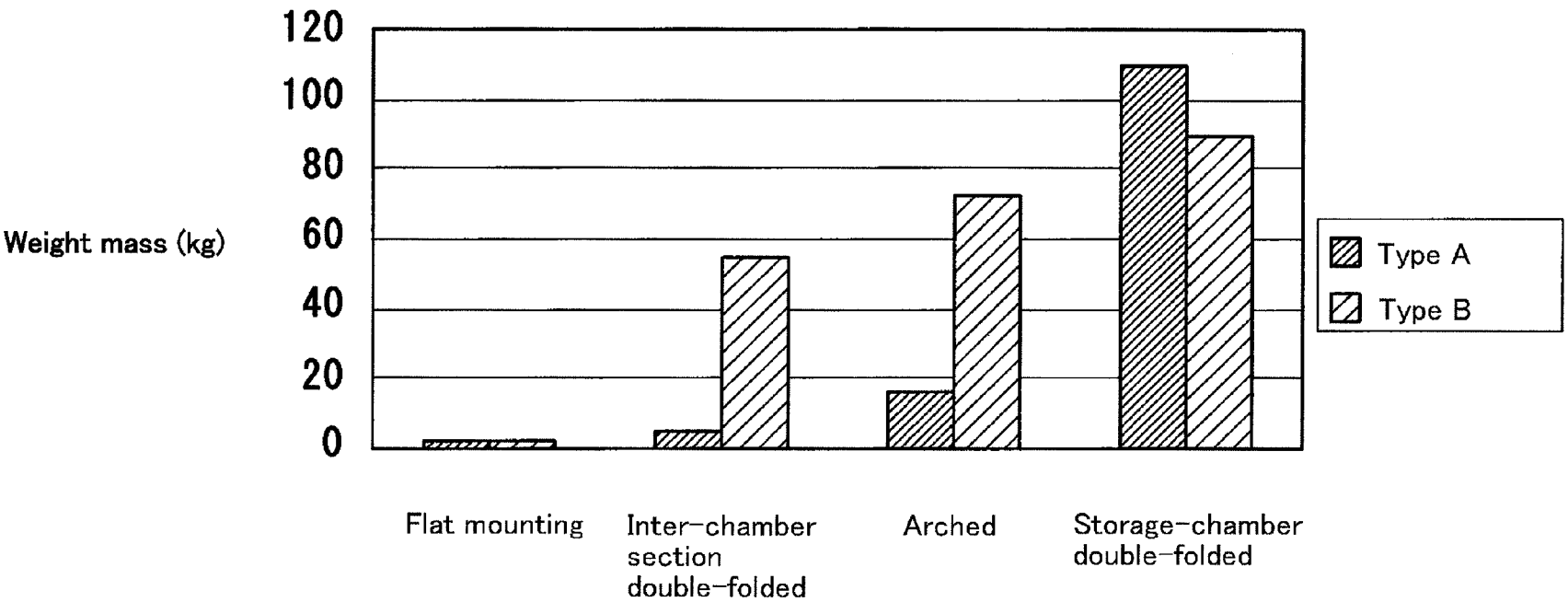
FIG. 8 shows the differences in the load bearing performance.

FIG. 7 shows the results of the abovementioned load bearing test. FIG. 8 shows the resistance of the mock inter-chamber section 1032 against being opened. As is obvious from FIG. 7 and FIG. 8, the mass of the weights 1040 at which the mock inter-chamber section 1032 opens in the case of "flat mounting" significantly differs from the other ways of mounting. Further, the effect exhibited by the folding up in the case of "type A" is greater compared to the case of "type B." This indicates that it is possible to powerfully keep the leakage of the swallowing aid substance 40 in check by providing, like in the pharmaceutical composition 700, a storage-chamber aid substance chamber 622 and a universal aid substance chamber 624 and bending the inter-chamber section 640 located therebetween. Further, the effect of keeping the leakage of the swallowing aid substance of "type B" in the case of "storage chamber double-folded" in check is very much stronger when compared to "type A."

Embodiment 3

The following explains embodiment 3 of this invention. Note that items which are identical with those explained in any of embodiments 1 or 2 are given identical reference numerals. In this embodiment, the detailed explanation thereof will not be repeated.

<Explanation of the Structure>

The differences between the pharmaceutical composition container 700 of this embodiment and the pharmaceutical composition container 600 of embodiment 2 are as follows. The first is that, whereas the pharmaceutical composition container 600 in embodiment 2 is provided with a body-side incision 666 and a passage-side incision 674, the pharmaceutical composition container 700 of this embodiment does not have such incisions. The second is that a notch 766 is provided in a position of the side strong seal 690 that is adjacent to the inter-chamber strong seal section 642. All other features of the pharmaceutical composition container 700 of this embodiment and the pharmaceutical composition container 600 of embodiment 2 are the same. Accordingly, detailed explanations thereof will not be repeated.

<Explanation of the Production Process>

In the manufacturing process for the pharmaceutical composition container 700 of this embodiment, the process until the folding to a U-shape is the same as in embodiment 2; therefore a detailed explanation thereof will not be repeated here. The following explains the process after the pharmaceutical composition 700 is bent into a U-shape.

Figure 9:
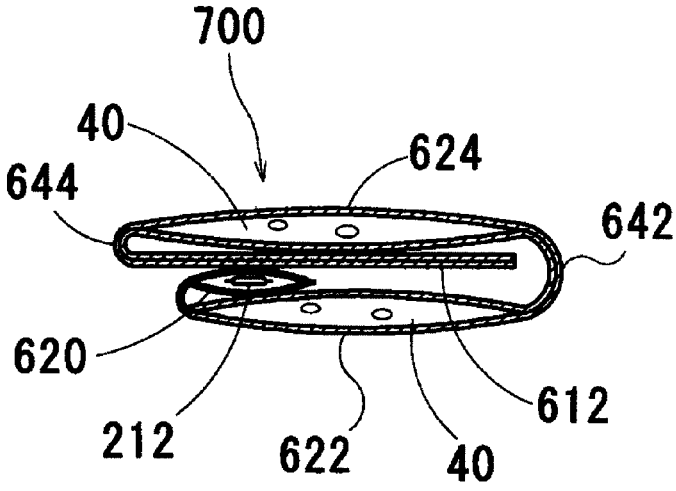
FIG. 9 is a cross section of the folded-up pharmaceutical composition container of the embodiment 3 of this invention.

When the pharmaceutical composition container 700 is bent into a U-shape, the portion corresponding to the curve of the "U" is bent more while the portions corresponding to the two tips of the "U" are not folded. Thereby the pharmaceutical composition container 700 is folded up. In the case of this embodiment, the inter-chamber strong seal section 642 and the boundary section 644 are folded. In the case of this embodiment, the pharmaceutical composition storage chamber 620 contacts the storage-chamber aid substance chamber 622 at this time. The passage section 612 is in contact with the universal aid substance chamber 624. The pharmaceutical composition storage chamber 620 and the passage section 612 are adjacent to each other. FIG. 9 is a cross section of the pharmaceutical composition container 700 that is folded up in such manner.

Figure 10:
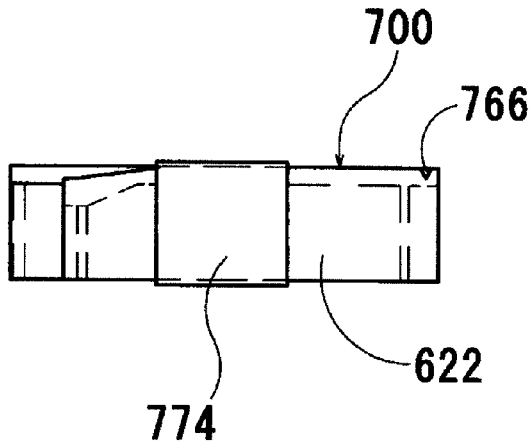
FIG. 10 is an external view showing the band fitted around the pharmaceutical composition container of the embodiment 3 of this invention.
Figure 11A:
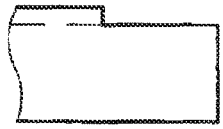
FIG. 11 is an external view of the cap-section tip portion in the alternative example of this invention.
Figure 11B:
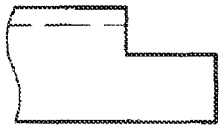
Figure 11C:
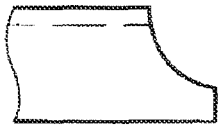
Figure 11D:
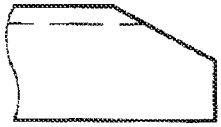
Figure 11E:
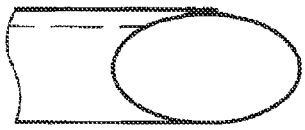
Figure 11F:
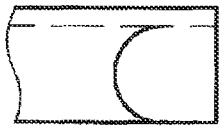
Figure 11G:
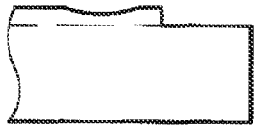

When the pharmaceutical composition container 700 is folded up, a band 774 is fitted around the pharmaceutical composition container 700. In the case of this embodiment, the band 774 is a ring for which synthetic resin is used as the material and which is seamless. FIG. 10 is an external view of the pharmaceutical composition container 700 around which the band 774 is fitted. The pharmaceutical composition container 700 of this embodiment is distributed in this state.

<Usage Method>

Except that, first, the band 774 is removed and the two folded-up ends are spread out, the usage method for the pharmaceutical composition container 700 of this embodiment is the same as that of embodiment 1. Accordingly, detailed explanations thereof will not be repeated.

Special Notes on the Pharmaceutical Composition Container of this Embodiment

From the special notes to be given on the pharmaceutical composition 700 of this embodiment, those that are different from the special notes on the pharmaceutical composition container 600 of embodiment 2 are as follows. The first is that the pharmaceutical composition container 700 is folded at the inter-chamber strong seal section 642 and the boundary section 644. The second is that the pharmaceutical composition storage chamber 620 and passage section 612 are covered by the storage-chamber aid substance chamber 622 and the universal aid substance chamber 624. The third is that the cover state is maintained by the band 774.

<Explanation of the Effect>

Except for the effect that the cover state is not easily released, the effect produced by the pharmaceutical composition container 700 of this embodiment is the same as that of the pharmaceutical composition container 600 of the embodiment 2. Moreover, a band 774 is fitted around the pharmaceutical composition container 700 of this embodiment. Thereby the abovementioned cover state is maintained. Because the abovementioned cover state is maintained, the portion entering the mouth of the patient is not easily stained.

Explanation of Alternative Examples

The pharmaceutical composition containers 400, 600 and 700 explained in the embodiments are presented as examples to concretize the technical concept of this invention. The material properties of the sheet are not limited to the abovementioned embodiments. The shape of sheet, the shape of the spaces, the shape of the aperture, the dimensions, structures and positioning thereof are not limited to those mentioned in the abovementioned embodiments. It is possible to apply various changes to the pharmaceutical composition containers 400, 600 and 700 explained in the embodiments within the scope of the technical concept of this invention.

For example, the pharmaceutical composition containers 400, 600 and 700 of this invention are not limited to containers made by double-folding and adhering a sheet. The pharmaceutical composition containers 400, 600 and 700 may also be made by adhering two sheets to each other or by adhering one tube at several positions. The pharmaceutical composition containers 400, 600 and 700 may be formed by blow molding. Further, the material of the pharmaceutical composition containers 400, 600 and 700 is not limited to the abovementioned material. For example, the material of the pharmaceutical composition containers 400, 600 and 700 may also be a composite material of polyethylene or another type of synthetic resin and aluminum. Examples for such kind of composite material include an aluminum film having layers of a synthetic resin such as polyethylene formed on the surface and back face thereof.

Further, the form of the pharmaceutical composition is not limited to a powdered or granular form. The ingredients of the pharmaceutical composition are also not limited. Of course, the pharmaceutical composition does not have to be stored in the encapsulating item 212.

Further, the form of the folding margin 680 is not limited to the abovementioned form. For example, the folding margin may be provided on the edge of the pass-through mouth section 672 so as to protrude from said edge. It is also possible to cut out a part of the edge of the pass-through mouth section 672 and use said part as the folding margin. FIG. 11 is an external view of the passage section tip portion of the alternative example in this invention. The figure shows examples for various forms of the folding margin.

Further, the swallowing aid substance 400 is not limited to a jelly having the outer appearance of a water-containing sterilized viscous fluid. However, the swallowing aid substance 40 that is stored in the storage-chamber aid substance chamber 420 or the cap-section aid substance chamber 424 needs to be a fluid which has a viscosity that is sufficient to take with it the object-to-be-swallowed when being moved into the mouth of a human or an animal, and which is swallowable by a human or an animal. Examples for such kind of swallowing aid substance include thick syrup, honey, custard cream, peanut spread and cheese spread. Further, if the swallowing aid substance 40 is not sterilized, it is preferable that the swallowing aid substance 40 contains a preservative. Further, the swallowing aid substance 40 does not have to be a fluid during the storage of the pharmaceutical composition containers 400, 600 and 700. For example, the swallowing aid substance 40 may be a powder or another type of solid during the storage of the pharmaceutical composition containers 400, 600 and 700. In this case, purified water or another type of solvent medium is stored in an inside space of the pharmaceutical composition containers 400, 600 and 700, and the swallowing aid substance 40 may become a fluid by dissolving in the solvent medium.

Figure 12A:
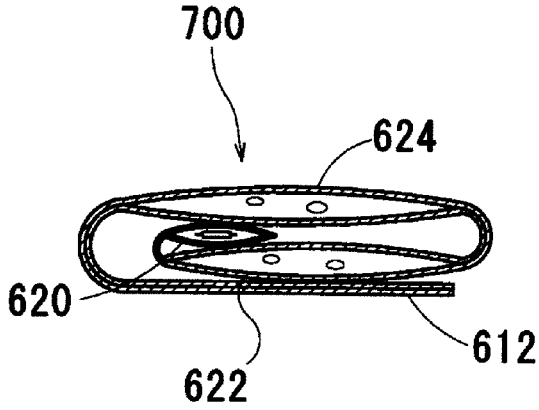
FIG. 12 is a cross section showing various ways to fold up the pharmaceutical composition container of the embodiment 3 of this invention.
Figure 12B:
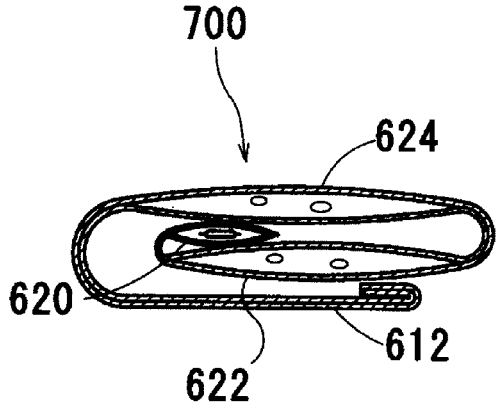
Figure 12C:
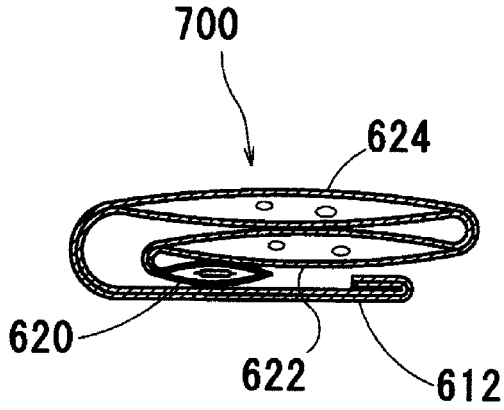

Further, the way in which the pharmaceutical composition container 700 in embodiment 3 is folded up is not limited to the abovementioned one. FIG. 12 shows cross sections of various ways to fold up the pharmaceutical composition container 700. Note that FIG. 12(C) shows an example in which the tip of the cap section 612 is folded, but naturally, the tip of the cap section 612 does not have to be folded.

Figure 13:
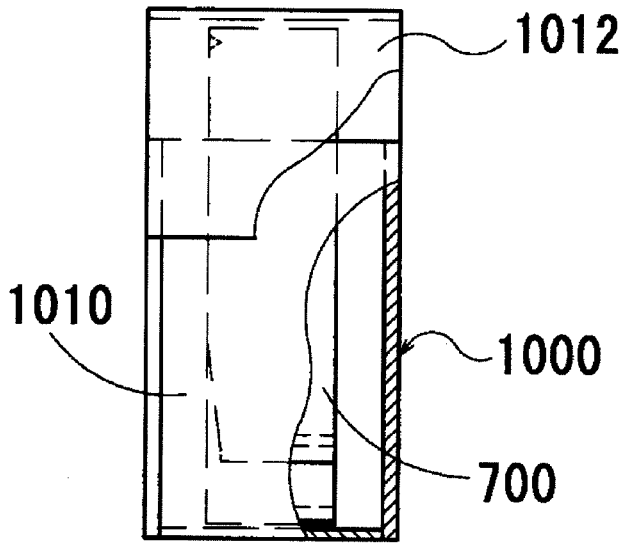
FIG. 13 is a partial cross section showing the state where the pharmaceutical composition container in the embodiment 3 of this invention is stored in a lidded bag.

Further, the distribution form of the pharmaceutical composition container 700 in embodiment 3 is not limited to the abovementioned one. FIG. 13 is a partial cross section showing the pharmaceutical composition container 700 being stored in a lidded bag 1000. The lidded bag 1000 is equipped with a bag body 1010 and a lid 1012. The bag 1000 is formed by triple-folding one synthetic resin sheet. The bag body 1010 is formed by one end and the center portion of the synthetic resin sheet being adhered to each other. The other end serves as the lid 1012. The pharmaceutical composition 700 does not have to be stored in a lidded bag 1000 like that mentioned above but also may be stored in a bag formed by adhering the edges of two synthetic resin sheets to each other. The pharmaceutical composition container 700 may be stored in a common zipper bag. The pharmaceutical composition container 700 may be distributed in a state where one end thereof is covered by a cover. As an alternative to the synthetic resin band 774, a rubber band may be used. The width of the band 774 or the rubber band is not limited in particular. The pharmaceutical composition container 600 of embodiment 2 may be stored in these bags.

Further, in the abovementioned embodiments, the pass-through mouth sections 472 and 672 of the cap sections 404 and 612 do not have to serve as an exit for the swallowing aid substance 40. In this case, the pass-through mouth sections 472 and 672 serve as an entrance for a pharmaceutical composition that is different from the pharmaceutical composition inside the pharmaceutical composition storage chambers 422 and 620. In this case, a pharmacist or the like may seal the pass-through mouth sections 472 and 672 after the pharmacist or the like has filled the pharmaceutical composition into the cap sections 404 and 612. The pharmaceutical composition containers the pass-through mouth sections 472 and 672 of which were sealed, are handed over to the patient. The patient breaks one end of the cap sections 404 and 612 to create an aperture thereon. Thereby it becomes possible to swallow the pharmaceutical composition inside the cap sections 404 and 612. Thereby, it also becomes possible to keep the pharmaceutical composition containers 400 and 600 with a pharmaceutical composition that is different from the pharmaceutical composition in the pharmaceutical composition storage chambers 422 and 620, being stored in the cap sections 404 and 612. It becomes unnecessary to check the type and quantity of the pharmaceutical composition each time the pharmaceutical composition is to be swallowed. As a result, the ease-of-use for the patient can be improved. Note that it is preferable that a predetermined passage aperture section is provided on the cap sections 404 and 612 in order to facilitate the breaking of one of the ends of the cap sections 404 and 612. The predetermined passage aperture section is a portion where an aperture is to be formed. A specific example for a predetermined passage aperture section is a V-shaped incision provided on the cap sections 404 and 612.

Further, the structure of the inter-chamber strong seal section 642 in embodiments 2 and 3 is not limited to the abovementioned one. For example, the inter-chamber seal section 642 does not have to be divided into a first zone 660, an intermediate chamber 662 and a second zone 664. In this case, the inter-chamber strong seal section 642 may be a uniform portion where the surfaces of the sheet are adhered to each other.

Further, in the abovementioned embodiments, the number of spaces provided in the container body of the pharmaceutical composition container is not limited to three. The number of spaces may be larger than three, or may be two.

Further, the size of the spaces comprised in the pharmaceutical composition containers 400, 600 and 700 is not particularly limited. However, it is preferable that the volume of these spaces is not larger than approximately 10 cc.

Further, it is needless to say that how strongly to bend the portions that are bent in the abovementioned pharmaceutical composition containers 400, 600 and 700, can be decided freely. For example, in the abovementioned embodiments, the inter-chamber section 441 and boundary section 445 of the embodiment 1 may be bent in such a manner that the bent portion forms a sharp angle or may be bent in such a manner that the portion forms a curve. Again, that the bent portions may be bent so as to form a sharp angle or so as to form a curve is not limited to the inter-chamber section 441 and the boundary section 445 of embodiment 1.

Further, it is needless to say that the structure of the abovementioned inter-chamber sections 441 and 640 and of the boundary sections 445 and 644 is not limited to the abovementioned ones. It is also needless to say that, for example, the sections may have a uniform structure formed by adhering the surfaces of the sheet to each other so as to have a weaker strength than the strength of the side strong seals 410 and 690 and of the inter-chamber strong seal sections 443 and 642.

EXPLANATION OF THE REFERENCE NUMERALS

40: swallowing aid substance
212: encapsulating item
400, 600, 700: pharmaceutical composition container
402, 610: container body
404: cap section
410, 690: side strong seal
420, 622: storage-chamber aid substance chamber
422, 620: pharmaceutical composition storage chamber
424: cap-section aid substance chamber
430: tip portion
441, 640: inter-chamber section
443, 642: inter-chamber strong seal section
445, 644: boundary section
447, 630: predetermined aperture section
450, 460, 650, 660, 682: first zone
452, 462, 652, 662, 684: intermediate chamber
454, 464, 654, 664, 686: second zone
472, 672: pass-through mouth section
612: passage section
624: universal aid substance chamber
666: body-side incision
670: counter mouth section
674: passage-side incision
676: bending section
680: folding margin
766: notch
774: band
1000: lidded bag
1010: bag body
1012: lid
1020: test container
1030: first storage chamber
1031: end section
1032: mock inter-chamber section
1034: second storage chamber
1040: weight
1050: mass measuring device

What is claimed is:

1. A container for orally ingested pharmaceutical composition which comprises a plurality of spaces inside the container body, wherein:

one of the aforementioned spaces is a pharmaceutical composition storage chamber in which a pharmaceutical composition is stored, one of the spaces is a storage-chamber aid substance chamber that is adjacent to the aforementioned pharmaceutical composition storage chamber and has a swallowing aid substance pre-stored therein, a predetermined aperture section is provided on the aforementioned container body where an aperture is to be formed to interconnect the outside of the aforementioned container with the aforementioned pharmaceutical composition storage chamber, of the aforementioned container body, an inter-chamber section which seals the portion between the aforementioned pharmaceutical composition storage chamber and the aforementioned storage-chamber aid substance chamber opens when force is applied from the outside of the aforementioned container body, a flexible section is provided in any portion of the storage-chamber aid substance chamber, the flexible section provided in the storage-chamber aid substance chamber is bent, the aforementioned container for orally ingested pharmaceutical composition is, in addition to the aforementioned container body, equipped with a cap section that is integrally provided on the aforementioned container body, the aforementioned container body comprises at least three of the aforementioned spaces, any one of the aforementioned spaces is a cap-section aid substance chamber which is adjacent to the aforementioned cap section and has a swallowing aid substance pre-stored therein, the aforementioned three or more spaces and the aforementioned cap section are arranged so as to form one line, in addition to the aforementioned inter-chamber section, the boundary section which seals the portion between the aforementioned cap-section aid substance chamber and the inside of the aforementioned cap section, opens up when force is applied from the outside of the aforementioned container body, the aforementioned flexible section in the aforementioned storage-chamber aid substance chamber is bent to removably insert the one of the two ends of the aforementioned container body that is on the opposite side of where the aforementioned cap section is provided, into the cap section, the container is made of a folded resin sheet, and the cap section is formed between end folds of the folded resin sheet.

2. A container for orally ingested pharmaceutical composition which comprises a plurality of spaces inside the container body, wherein:

one of the aforementioned spaces is a pharmaceutical composition storage chamber in which a pharmaceutical composition is stored, one of the spaces is a storage-chamber aid substance chamber that is adjacent to the aforementioned pharmaceutical composition storage chamber and has a swallowing aid substance pre-stored therein, a predetermined aperture section is provided on the aforementioned container body where an aperture is to be formed to interconnect the outside of the aforementioned container with the aforementioned pharmaceutical composition storage chamber, of the aforementioned container body, an inter-chamber section which seals the portion between the aforementioned pharmaceutical composition storage chamber and the aforementioned storage-chamber aid substance chamber opens when force is applied from the outside of the aforementioned container body, a flexible section is provided in any portion of the storage-chamber aid substance chamber, the flexible section provided in the storage-chamber aid substance chamber is bent, the aforementioned container for orally ingested pharmaceutical composition is, in addition to the aforementioned container body, equipped with a cap section that is integrally provided on the aforementioned container body, the aforementioned container body comprises at least three of the aforementioned spaces, any one of the aforementioned spaces is a cap-section aid substance chamber which is adjacent to the aforementioned cap section and has a swallowing aid substance pre-stored therein, the aforementioned three or more spaces and the aforementioned cap section are arranged so as to form one line, in addition to the aforementioned inter-chamber section, the boundary section which seals the portion between the aforementioned cap-section aid substance chamber and the inside of the aforementioned cap section, opens up when force is applied from the outside of the aforementioned container body, the aforementioned flexible section in the aforementioned storage-chamber aid substance chamber is bent to removably insert the one of the two ends of the aforementioned container body that is on the opposite side of where the aforementioned cap section is provided, into the cap section, the container is made of a folded resin sheet, the cap section is formed between end folds of the folded resin sheet, and the aperture section is inserted into the cap section.

* * * * *